US006786152B2

(12) United States Patent
Zschetzsche et al.

(10) Patent No.: US 6,786,152 B2
(45) Date of Patent: Sep. 7, 2004

(54) DOSING SYSTEM FOR INKING UP ROLLERS IN A PRINTING MACHINE

(75) Inventors: Hubert Zschetzsche, Offenbach (DE); Peter Hummel, Offenbach (DE); Robert Ortner, Alzenau (DE)

(73) Assignee: MAN Roland Druckmaschinen AG, Offenbach/Main (DE)

( * ) Notice: Subject to any disclaimer, the term of this patent is extended or adjusted under 35 U.S.C. 154(b) by 0 days.

(21) Appl. No.: 10/258,781

(22) PCT Filed: Apr. 12, 2001

(86) PCT No.: PCT/EP01/04229

§ 371 (c)(1),
(2), (4) Date: Feb. 12, 2003

(87) PCT Pub. No.: WO01/81086

PCT Pub. Date: Nov. 1, 2001

(65) Prior Publication Data

US 2003/0192442 A1 Oct. 16, 2003

(30) Foreign Application Priority Data

Apr. 26, 2000 (DE) ..... 100 20 510

(51) Int. Cl.[7] ..... B41F 31/00

(52) U.S. Cl. ..... 101/349.1; 101/350.5; 101/364; 101/367

(58) Field of Search ..... 101/350.5, 350.6, 101/364–367, 178, 349.1, 483

(56) References Cited

U.S. PATENT DOCUMENTS 4,290,362 A 9/1981 Kobler et al.
4,354,449 A * 10/1982 Zink ..... 118/206
4,488,483 A * 12/1984 Kohara ..... 101/350.6
4,527,477 A * 7/1985 Galster et al. ..... 101/365
4,527,479 A * 7/1985 Dahlgren ..... 101/450.1
4,602,564 A * 7/1986 Sakamoto et al. ..... 101/350.5
4,753,165 A * 6/1988 Grosshauser ..... 101/148
4,960,052 A 10/1990 Junghans
5,003,871 A 4/1991 Franz et al.

(List continued on next page.)

FOREIGN PATENT DOCUMENTS

| | | |
|---|---|---|
| DE | 27 11 553 A1 | 9/1978 |
| DE | 28 56 088 A1 | 7/1980 |
| DE | G 84 01 569.1 | 8/1988 |
| DE | 37 06 602 A1 | 9/1988 |
| DE | 38 04 204 A1 | 8/1989 |
| DE | 42 41 809 A1 | 6/1994 |
| DE | 196 09 946 A1 | 9/1997 |
| DE | 199 38 301 A1 | 3/2000 |
| EP | 0 309 681 A2 | 4/1989 |
| EP | 0 752 311 A2 | 1/1997 |
| GB | 1 560 160 | 1/1980 |

*Primary Examiner*—Eugene H. Eickholt
(74) *Attorney, Agent, or Firm*—Leydig, Voit & Mayer, Ltd

(57) ABSTRACT

An ink metering system for a roller train in a printing machine which in the illustrated embodiment includes a fountain roller and a downstream train of rollers communicating with a plate or form cylinder of the printing press. One or more plating devices (12) are provided which each have a plate-like element (19) adjustably positionable with respect to a respective roller for leveling ink on the surface of the roller before or after passage through a contact zone with an adjacent roller in which ink is pulled off and separated between the rollers. The plating devices are relatively simple in construction and operation and provide stable ink guidance on the roller surfaces that noticeably improves print quality.

22 Claims, 4 Drawing Sheets

U.S. PATENT DOCUMENTS 5,097,762 A * 3/1992 Nakano et al. ..... 101/157
5,121,689 A * 6/1992 Fadner ..... 101/365
5,372,067 A * 12/1994 Doyle et al. ..... 101/148
5,386,773 A 2/1995 Flade
5,709,148 A * 1/1998 Uera et al. ..... 101/365
5,735,208 A 4/1998 Hummel et al.
5,983,798 A * 11/1999 Iijima et al. ..... 101/365
6,129,021 A 10/2000 Vrotacoe et al.

* cited by examiner

DOSING SYSTEM FOR INKING UP ROLLERS IN A PRINTING MACHINE

FIELD OF THE INVENTION

The present invention relates generally to inking systems for printing machines, and more particularly, to inking systems in which ink or lacquer can be directed through a roller train leading to a plate or form cylinder.

BACKGROUND OF THE INVENTION

A printing machine with a vibrating inking unit is known from DE 37 06 602 A1. Here, an ink fountain roller is associated with an ink fountain having a metering system for the printing ink, as is known from DE 27 11 553 A1. For printing machines with a vibrating inking unit, the printing ink is periodically removed in strips from an ink fountain roller by back and forth pendulate motion of an ink vibrating roller and fed to an inking unit roller of the subsequent roller train. Limited by the different rotational speeds of the ink fountain roller and the inking unit roller, vibrating inking units have the problem that the inking vibrating roller is delayed or accelerated with each strike (contact) with the ink fountain roller or the inking unit roller. With such striking or lifting of the vibrating roller, there is non-uniform ink guidance during transport of the printing ink, in connection with an up-and-down ink separation in the contact zone of the rollers, as well on the ink fountain roller or on the inking unit roller, which adversely affects the printing quality. Due to the ink separation of the printing inks between the ink fountain roller and the ink vibrating roller, as well as between the ink vibrating roller and the subsequent inking unit roller, uneven surface structures are formed for the remaining ink on the roller surfaces, which further leads to reduced printing quality on the material.

From DE 38 04 204 A1, a printing machine inking unit with a film roller is known. Such a film roller is designed for the ink transport across a film gap (first contact zone) in contact with the ink fountain roller, as well as in a second contact zone with the subsequent inking unit roller of a subsequent roller train, so that a continuous ink transport of printing ink between the ink fountain roller and the inking unit roller of the roller train can be effected. In addition, an intermediate roller is arranged in contact with the film roller and a doctor blade roller is arranged after this intermediate roller. In contact with the doctor blade roller is an adjustable doctor blade, and the doctor blade can be set or adjusted depending on the subject or at intervals on the doctor blade roller. The printing ink removed by the doctor blade roller is then led back into the ink fountain. This film inking unit is used for minimizing the amount of ink by removing a portion of ink from an inking unit and is relatively expensive due to the use of additional rollers (intermediate roller, doctor blade roller). In the contact zones of the ink fountain roller and film roller and the film roller and subsequent inking unit roller, there occurs, analogous to the above described vibrating inking unit, an ink separation of the printing ink per contact zone so that also for film inking units, which results in uneven surface structures being formed in the ink on the roller surfaces which leads to reduced printing quality on the printing material.

Furthermore, from DE 196 09 946 A1 there is known a printing machine with an applicator for inking a roller of an inking unit. The applicator consists of a storage container with ink or lacquer or a comparable medium, which has an associated metering roller. The metering roller is in friction contact with a drivable roller for ink transfer and thus forms a contact zone in which ink or lacquer separation occurs.

According to DE 42 41 809 A1, a printing machine with a device for the inking of rollers is known, which leads ink from a storage container under compressed air according to zones in the axial direction of the rollers onto their outer surfaces. In this way, there is no contact on the side of the device with the outer surface of the associated rollers to be inked. The zone-wise deposited ink forms a different amount of ink on the outer surface of the inked roller, which exhibits an uneven surface structure for the ink.

Such an uneven surface structure for the ink on the outer surface of a roller results from pulling off of the ink, e.g., for ink emerging from a storage container and striking an outer surface, or after an ink separation process (division of the ink layer) in the contact zone of two rollers or the contact zone of a roller with a stripping system, e.g., an ink metering system.

From DE 199 38 301 A1 there is known an inking unit for a printing machine for the uniform application of ink. Starting from the fact that there is tension at the roller gap formed by two rollers, there results a non-uniform ink transfer. Such tension influences, e.g., the line pressure in the roller gap of two rollers, and this different line pressure effects, e.g., a non-uniform ink transfer, which appears on the printing material as an ink film that has been applied non-uniformly. For improving the ink transfer, there is at least one smoothing element associated with an inking unit roller that removes shearing forces of the ink. Preferably, the smoothing element is associated with an ink applying roller and/or an ink friction roller adjacent to the plate cylinder.

OBJECTS AND SUMMARY OF THE INVENTION

It is an object of the present invention to provide a inking system for ink or lacquers in a printing machine which is relatively economical in construction and adapted for uniform, stable ink or lacquer guidance on one or more roller surfaces for improved printing quality.

It has been found that on the outer surface of an ink or lacquer guiding roller, after the pulling off (shearing) of ink (or lacquer) in a contact zone, the ink/lacquer distribution is not uniform across the roller width. On the roller there is an uneven surface structure of ink (lacquer), which is characterized by ink peaks or ink cones and ink valleys (or lacquer peaks, lacquer cones, lacquer valleys) on the outer surface of an ink-guiding roller.

For example, for an ink fountain roller, after the ink separation (splitting of ink layer) in a contact zone with another roller, e.g., a vibrating or film roller, through pulling off of ink/lacquer, particularly for thread-like pulling off, the ink/lacquer distribution is not uniform across the roller width, but instead there is an uneven surface structure of the remaining ink (or the remaining lacquer) on the outer surface of the ink fountain roller. This also applies to ink zones generated within an ink metering system having ink metering elements where layer thickness is defined in zones, because in that case a pulling off of ink or lacquer also occurs as a consequence of the shearing forces separating the ink (lacquer).

A first advantage of the present invention is based on the fact that for an uneven surface structure (peaks, cones, and valleys) of ink (lacquer) which results from prior pulling off of ink (lacquer), at least one ink-guiding (or lacquer-guiding) roller is assigned to at least one plating device at its periphery. The plating device effects a shape change (plastic shaping) of the ink peaks or ink cones and ink valleys (or lacquer peaks, lacquer cones, lacquer valleys) within the surface structure of the ink (or lacquer). The shape change represents a micro-conversion of the surface structure of the ink (lacquer). For such a shape change of the ink (lacquer), the ink peaks or ink cones (lacquer peaks, lacquer cons) slide into the ink valleys (lacquer valleys), i.e., smoothing processes are performed within the ink layer on the ink texture (lacquer texture), which effect plastic shaping so that an approximately even surface structure can be achieved with a defined layer thickness. The plastic shaping by the plating device is advantageous because the ink or the lacquer is not exposed to a shearing effect (shearing or dispersion effect). A shearing effect leads, in turn, to undesired pulling off of ink or lacquer and thus to uneven surface structure.

The relatively even surface structure of ink (or lacquer) achieved by the plating device has the effect that ink/lacquer density variations can be noticeably reduced on the printing material so that the printing/gloss or reflective quality is noticeably improved. As a result, there is an even surface structure of the ink or remaining ink or lacquer on the outer surface of the corresponding roller across the roller width before the roller comes in contact with a subsequent contact zone (e.g., a gap position). With such a plating device, this uneven surface structure of the ink or remaining ink or lacquer is clearly leveled in an advantageous way on the associated roller, e.g., the ink fountain roller, so that a uniform surface structure of the ink or remaining ink or lacquer can be achieved for a uniform, stable ink/lacquer guidance in the roller train.

The use of a plating device, particularly on an ink fountain roller, is advantageous because a clearly reduced amount of printing ink in the metering gap (gap between ink metering system, e.g., ink valves, and ink fountain roller) is passed through the metering gap. It is likewise an advantage that particularly the parameters changing during the printing process, such as printing speed, temperature, ink amount, hydrodynamic pressure in the ink fountain, as well as the viscosity of the printing ink or the lacquer, are noticeably reduced as possible interference variables by the use of a plating device according to the invention.

Another advantage is that the plating device according to the invention is not limited to one ink fountain roller. The arrangement of plating devices can also be realized for other ink-guiding (including lacquer-guiding) rollers of an inking unit. Here, preferably at least one plating device is assigned to each roller. Alternatively, several plating devices can also be arranged for one roller.

It is likewise advantageous if the surfaces of the ink or remaining ink or lacquer, which are leveled uniformly by the plating device, lead to uniform ratios for the subsequent ink/lacquer separation (in the ink metering system) in the ink fountain or to uniform separation ratios between adjacent rollers (contact zones) themselves, which noticeably improves the print quality. With the leveling of ink or lacquer on the outer surface of a roller, a homogenous ink layer is created, which can be more easily metered. In this way, a smaller distance of the ink metering elements of the ink metering system to the roller for the same ink thickness (lacquer thickness) can be realized and a continuous ink flow achieved.

Furthermore, the inking unit according to the invention reduces by a considerable extent the interference of the ink flow through the independently controlled rpms and, if necessary, the direction of rotation of the roller, e.g., of the film roller, which can achieve better adaptation of the ink flow to the printing speed.

Furthermore, according to the geometry of the roller train in the inking unit, there is the possibility of reducing the number of inking rollers. Therefore, a uniform surface structure of the remaining ink or the remaining lacquer on a roller can be achieved with fewer gap points in order to achieve a defined layer thickness of the ink film on the plate cylinder. In this way, the roller train also can be shortened.

The plating device is used for creating a relatively even surface structure on the outer surface of a corresponding ink or lacquer-guiding roller. In the region of the plating device, a pulling off/shearing of ink or lacquer is to be prevented at the outer surface of the corresponding roller, because otherwise this leads to uneven surface structures. The configuration of the plating device is not limited to one or more mechanical plating device(s) with one or more plating element(s). For example, for achieving an even surface structure, an air doctor blade that introduces compressed or blown air onto the outer surface of the ink/lacquer guiding roller or an ultrasonic system directed onto the ink can be used in order to achieve plastic shaping.

Other objects and advantages of the invention will become apparent upon reading the following detailed description and upon reference to the drawings, in which:

Figure 1:
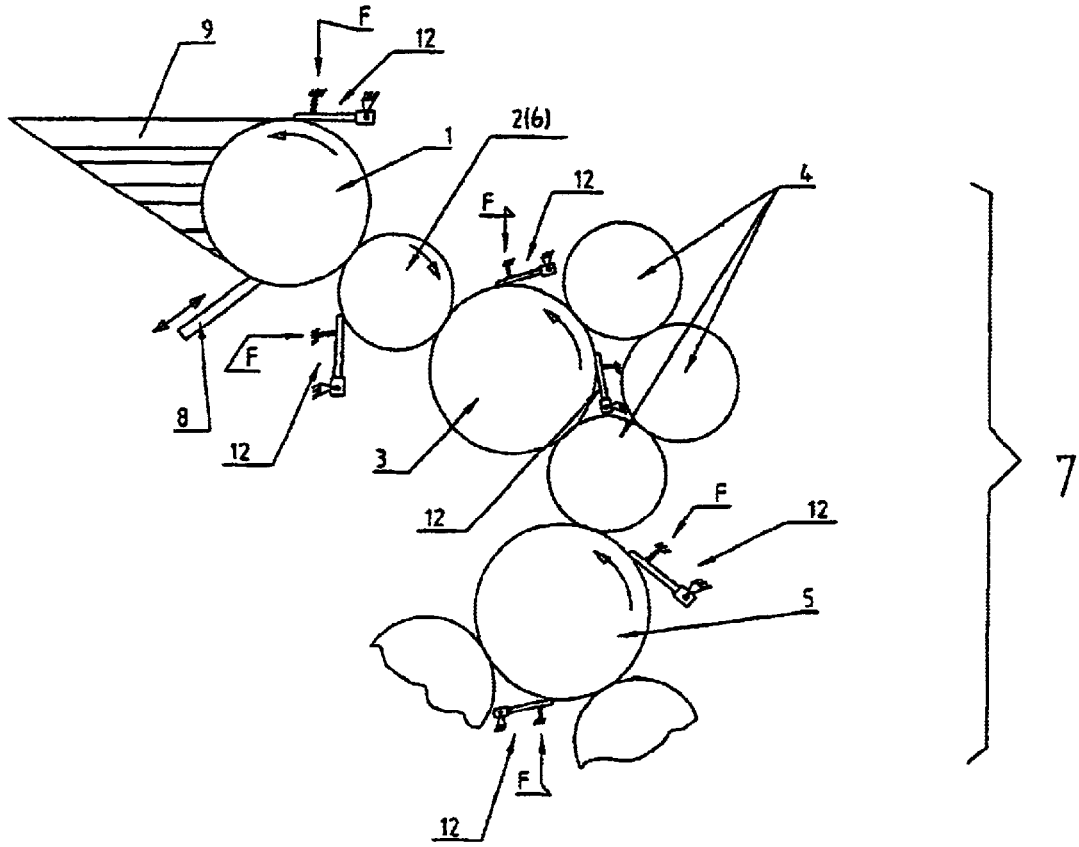
FIG. 1 is a partially diagrammatic side elevational view of a printing machine having an inking system in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1 of the drawings, there is shown an illustrative sheet-fed rotational offset printing machine having an inking system in accordance with the invention. The illustrated inking system has an inking unit with an ink fountain roller 1 associated with an ink fountain 90 which contains a liquid printing medium, such as printing ink or lacquer, with an ink metering device 8 for governing the flow of the printing medium onto the surface of the ink fountain roller 1 as it is rotated in a printing direction, as indicated by the arrow. The illustrated ink fountain roller is in contact with a downstream roller, which in the illustrated embodiment is a vibrating roller 2 or a film roller 6, which in turn communicates with a first inking unit roller 3, which may be a friction roller driven for rotational and transverse axial movement The first inking roller 3 in turn communicates with a subsequent ink train 7 that leads to an appropriate printing cylinder, in the form of a plate cylinder or form cylinder of a conventional type. The roller train 7 in this case includes a second inking unit friction roller 5, that can be rotatably and axially driven, together with a plurality of transfer rollers 4. As is known in the art, the cylinders of the inking unit are adapted for contact with each other in respective contact zones 10 where ink is separated and pulled off between contacting cylinders as the respective surfaces thereof arc rotated through the contact zone. For purposes herein, it will be understood that the inking system may be used for delivering ink or lacquers to the printing cylinder. For purposes herein, printing medium and/or printing ink is intended to include both printing inks and lacquers. Likewise, the term "printing cylinder" as used herein, is intended to encompass both plate and form cylinders.

In accordance with the invention, a plating device is associated with at least one of the inking unit rollers adjacent its outer surface for leveling and smoothing the ink on the surface of the roller. To this end, in the illustrated embodiment, a plating device 12 is located adjacent the form cylinder 1 after the contact zone 10 with the downstream cylinder (in this case the vibrating cylinder 2 or form cylinder 6) in the direction of rotation of the roller 1. The plating device 12 includes a plate-like element or elements that extends parallel across the full longitudinal length 15 of the roller 1 and is adjustably positionable with respect to the outer surface of the roller 1.

The plating device 12 preferably can be adjusted so that a predetermined force F is applied against the outer surface of the ink fountain roller 1. Hence, the plating device, preferably with a uniform surface pressure acting along the length 15 of the roller 1, will level and smooth remaining ink on the surface of the form cylinder 1 after passing through the contact zone 10 with the downstream cylinder 2, 6. Preferably, the plating device is adjustable in a tangential direction relative to the outer surface of the roller 1 in the direction of rotation. Alternatively, the plating device may be adjustable in a direction that forms a secant to the outer surface of the roller 1.

The plating device 12 in this instance includes a plate or plating element 19 which extends across the roller length 15 and is set at a tangent in the direction of rotation of the roller 1. The plating element 19 is held in a support 20 which in turn is supported at opposite ends by hinges 21 mounted on a frame. Hence, the plating element 19 is pivotal about the axis of the hinges 21 into and out of predetermined position with respect to the outer surface of the cylinder 1. The plating element 19 preferably is adjustably positionable with the assistance of a compression spring mounted on the frame such that the plating element 19 is loaded against the roller by a force F. Alternatively, instead of a compression spring, a cylinder, such as a pneumatic cylinder, or other means may be used, for urging the plating element against the roller with the force F. Likewise, depending upon the form of the plating element, its own weight could be used for positioning the plating element against the cylinder, without generating a shearing effect on the outer surface on the remaining ink. Alternatively, the plating device 12 can be arranged with the plating element at a predetermined small minimum distance to the outer surface of the roller in order to achieve the desired even surface of the printing ink on the roller. The plating element 19 preferably has its outer free end acting in a direction normal in to the tangent or secant point of the roller 1. Alternatively, the plating element can extend tangentially in the direction of rotation of the roller 1 slightly beyond its outer surface, which prevents pulling off of ink or lacquer.

Figure 2:
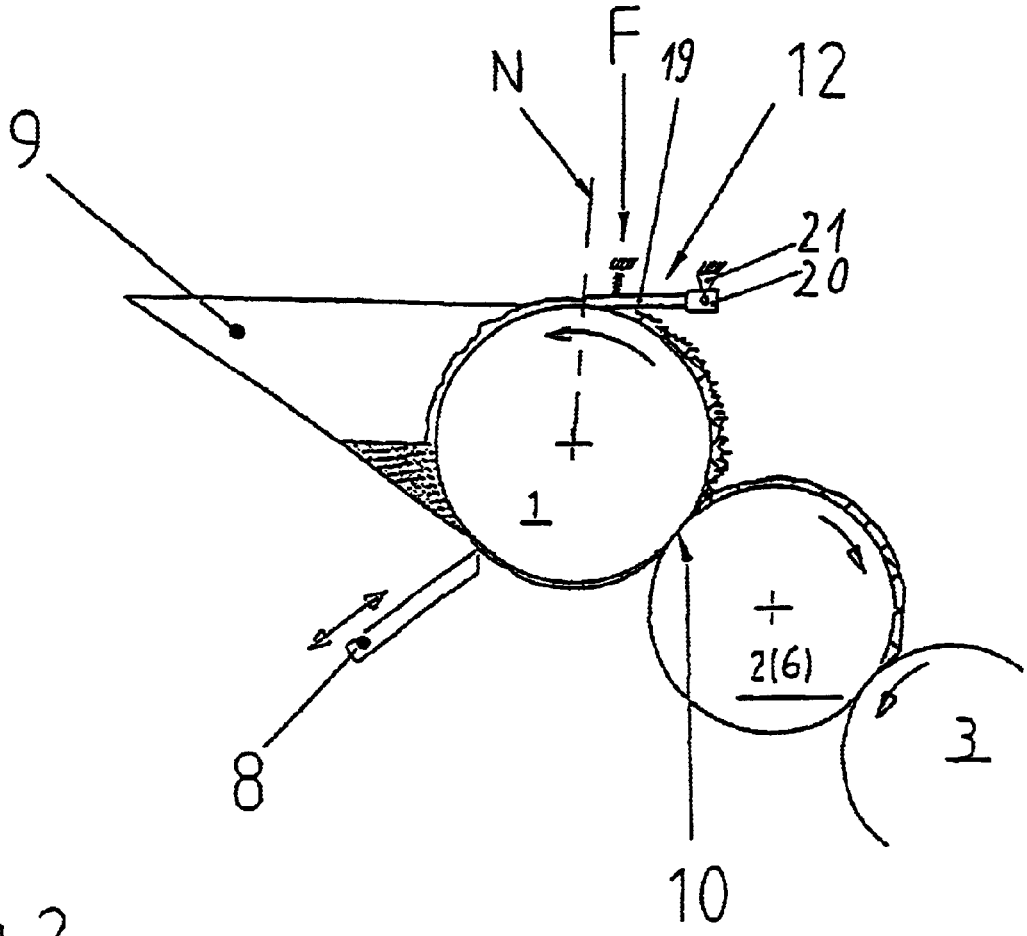
FIG. 2 is a partially diagrammatic depiction of an ink metering system in accordance with the invention operatively connected to an ink fountain roller.

Preferably, a plating device 12 according to the invention as depicted in FIGS. 1 and 2, is adjacent at least to the ink fountain roller 1 which can be inked with an offset printing ink. Here, the plating device 12 is arranged so that it can be adjusted tangentially in the direction of rotation of the ink fountain roller 1 after a contact zone 10 with an adjacent vibrating roller 2 or film roller 6 and before the ink metering system 8. Hence, the plating device 12 levels the uneven surface structure of the remaining ink on the outer surface of the ink fountain roller 1 after the contact zone 10 of the vibrating roller 2 or film roller 6, before the remaining ink comes into renewed contact with ink in the ink fountain 9 and the ink metering system 8.

Thus, in the direction of rotation of the ink fountain roller 1 there is a leveled surface structure of ink on the outer surface of the ink fountain roller 1 before the ink metering system 8 and possible ink passage into the region of the ink metering system 8 is noticeably reduced. In addition, by the use of the metering system 8 already at the ink fountain roller 1, possible ink thickness variations on the printing material can be noticeably reduced. The even surface structure leads, in turn, to the same ratios in a contact zone for the subsequent metering of printing ink in the ink fountain 9 with an ink metering system 8 or to the same ink separation ratios in a contact zone 10 of two rollers, e.g., of ink fountain roller 1 and vibrating roller 2.

The use of a plating device 12 is not limited to use with the ink fountain roller 1. The plating devices 12 can also be used at other rollers 2–6 of the inking unit Preferably, similar plating devices 12 (in addition to at least one plating device 12 at the ink fountain roller) provided for other of the rollers 2–6 of the inking unit, which are arranged at a distance upstream from the plate or form cylinder. This is because in the region of the film or vibrating roller 6, 2 and the second ink friction roller 5, a large layer thickness is transferred and level surface structures generated by single or several plating devices 12 reduce as much as possible ink thickness variations on the printing material.

In this aspect, in addition to the plating device 12 at the ink fountain roller 1, a plating device 12 is provided at the offset roller 2 or the film roller 6. In the direction of rotation of the offset or film roller 2, 6, after the contact zone 10 with the ink fountain roller 1 and before the contact zone 10 of the subsequent inking unit roller 3, another plating device preferably is tangentially mounted in the direction of rotation of the offset/film roller 2, 6.

In another refinement, in addition to the arrangement of the plating device 12 as described, there also is another plating device 12 for the ink fountain roller 1 and in the direction of rotation of this inking unit roller 3 after the contact zone 10 with the vibrating roller 2 or film roller 6 and before the contact zone 10 of at least one roller arranged after the inking unit roller 3, e.g., at least one transfer roller 4.

In another refinement, in addition to the arrangement of the plating device 12 assigned at least to the ink fountain roller 1, there also is another plating device 12 at least one drivable roller, preferably of the second ink friction roller 5 of the inking unit. In the direction of rotation of the ink friction roller 5 after their contact zone 10 with a directly adjacent roller, preferably a transfer roller 4, and preferably before the contact zone 10 with another directly adjacent roller of the inking unit, there is at least one other plating device 12 that can be adjusted preferably tangentially in the direction of rotation of the corresponding drivable ink friction roller 5.

The effect first will be explained with a refinement shown in FIG. 2. In the ink fountain 9, there is a storage container of printing ink, and an ink fountain roller 1 rotates into this container in its direction of rotation and is inked. In the following contact zone 10 in the direction of rotation, there is a pulling off of printing ink done by the ink metering device 8 and the inked ink fountain roller 1 leads the remaining printing ink to the next contact zone 10. This contact zone 10 is formed by the ink fountain roller 1 and the vibrating roller 2 (alternatively, the film roller 7). In this contact zone 10, ink separation occurs so that an ink layer 13 remains in defined layer thickness as the remaining ink on the ink fountain roller 1 and an ink film of defined layer thickness is transferred onto the vibrating roller 2 or film roller 6.

Figures 4A, 4B:
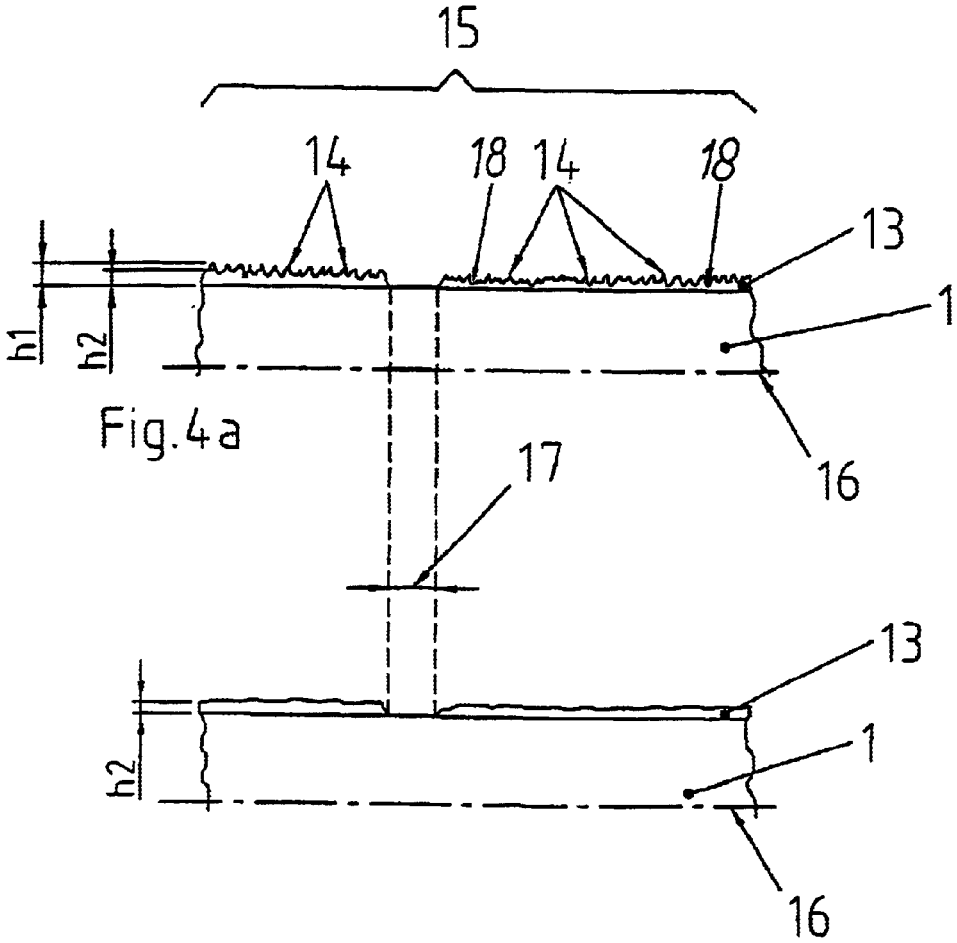
FIGS. 4A and 4B illustrate ink surface structures.

After the contact zone 10, as depicted in FIG. 4*a*, the remaining ink has an uneven surface structure in the form of ink peaks, ink cones 14 and also ink valleys 18 on the outer surface of the ink fountain roller 1. FIG. 4*a* shows this surface structure along the roller width 15 with a first layer thickness $h_1$ and, e.g., an ink zone 17. The ink fountain roller 1 now moves in the direction of rotation the plating device 12, which effects the form change (plastic shaping) of the ink peaks, ink cones 14, and also ink valleys 18, and, as a result, there is a relatively even surface structure with a second layer thickness $h_2$. In this way, the ratio of layer thickness is always: $h_1>h_2$. The adjusted ink profile with, e.g., the ink zone 17, remains essentially preserved.

It will be appreciated that the invention is not restricted to the present embodiments. The object of the invention starts from the observation that, in the direction of rotation of an inked roller 1–6 before a contact zone 10, where pulling off or separation of ink occurs, the ink or the remaining ink or also lacquer is leveled on the outer surface of the roller(s) 1–6 by means of at least one plating device 12. According to each configuration of the inking unit, a leveling of the ink or remaining ink or lacquer can be performed also before the first contact zone 10 where ink separation occurs.

Figure 3:
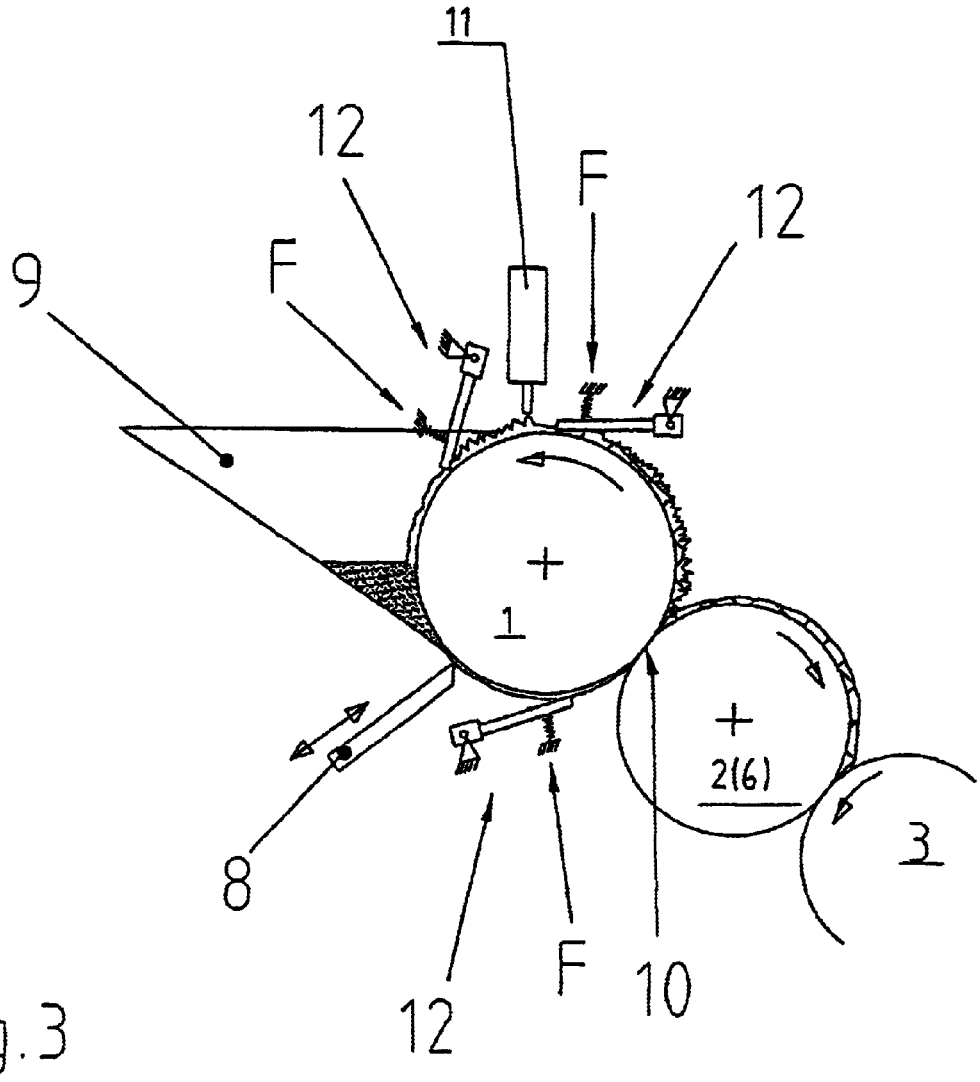
FIG. 3 is a partially diagrammatic depiction of an ink metering system in accordance with the invention which includes an ink fountain roller and a dispensing device.

For example, as depicted in the embodiment of FIG. 3, when ink/lacquer is fed by pulling off from a storage container of an ink dispensing device 11, e.g., of an ink cartridge, directly onto the outer surface of the associated roller, preferably the ink fountain roller 1 is inked, and in the direction of rotation of roller 1, an ink metering system 8 is provided in which separation of ink (lacquer) occurs. In this embodiment, the plating device 12 is adjustable in the direction of rotation of the ink fountain roller 1 after the ink dispensing device 11 and before the ink metering system 8 of the ink fountain roller 1.

Furthermore, in the direction of rotation of the inked ink fountain roller 1 (and/or other rollers 2–5) after the first contact zone 10, where pulling off or separation of ink occurs, the uneven surface structure of ink or remaining ink can be leveled on the outer surface of this ink fountain roller 1 by means of plating device 12 and subsequently the surface structure leveled on the outer surface can be fed to a second contact zone 10, where pulling off of ink (lacquer) or renewed ink/lacquer separation occurs.

In a further refinement, in the direction of rotation at least one inked roller 1–6 after the second contact zone 10, where a pulling off/separation of ink occurs, and before the first contact zone 10 where a pulling off or separation of ink occurs, the remaining ink or the remaining lacquer is leveled on the outer surface of this roller (1–6).

If the roller 1–6 is in contact at several contact points 10, where pulling off of the ink or the lacquer occurs, then at least one, and preferably several, plating devices 12 are provided for the corresponding roller 1–6 in the direction of rotation of the corresponding roller 1–6 before the next contact point 10.

For the arrangement of at least one plating device 12 in the region of the ink fountain roller 1 in the direction of rotation before the ink metering system 8, the plating device 12 also can be immersed in the ink fountain 9. The plating system 12 is preferably arranged so that it can be set and adjusted to each roller 1–6.

What is claimed is:

1. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, and a plating device (12) adjustably positioned a small distance relative to an outer surface of one of the rollers (1–6) after a contact zone (10) of the one roller in the direction of rotation of the one roller for leveling the remaining ink on the surface of the one roller after passage through the contact zone.

2. The printing press of claim 1 including a plating device (12) adjustably positionable to the outer surface of said one roller in the direction of rotation of the one roller before a contact zone 10 said one roller for further smoothing ink on the surface of said one roller.

3. The printing machine of claim 1 in which said plating device (12) is adjustably moveable in a direction parallel to the outer surface of the one roller (1–6).

4. The printing press of claim 1 in which said plate device (12) is adjustably movable with respect to the outer surface of said one roller in a direction that forms a secant with the outer surface.

5. The printing machine of claim 1 including a fountain roller (1) associated with said liquid printing medium storage container, a downstream roller in the form of a vibrating roller (2) or film roller (6) communicating through a contact zone with said fountain roller (1), a subsequent inking unit roller (3) communicating with said downstream roller (2, 6) through a contact zone (10), and said plating device (12) being provided on said downstream roller (2, 6) after the contact zone (10) with the ink fountain roller (1) and before the contact zone (10) with a subsequent inking unit roller (3).

6. The printing machine of claim 1 in which said roller train includes an intermediate roller in the form of a vibrating roller (2) or film roller (6), and an inking unit roller (3) communicating with said intermediate roller (2, 6) through a contact zone (10), and said plating device is positionable with respect to said inking unit roller (3) after the contact zone (10) with the intermediate roller (2, 6) and before a contact zone (10) with a further roller of the roller train.

7. The printing machine of claim 1 in which said roller train includes at least one drivable roller (3, 5) and at least two other rollers of the roller train in contact with the at least one drivable roller (3, 5) at respective contact zones (10), and said plating device 12 being adjustably positionable with respect to the said at least one drivable roller (3, 5) at a location in the direction of rotation of the at least one drivable roller (3, 5) after the contact zone with one of said other rollers of the roller train and before the contact zone with another of said other rollers of the roller train.

8. The printing machine of claim 1 in which said plating device (12) has a plating element (19) that extends across the entire length of the one roller and which is detachably mounted within a support (20).

9. The printing machine of claim 1 in which the plating device (12) has a plating element (19) mounted in a support (20) which in turn is mounted for pivotal movement by hinges (21) fixed to a machine frame.

10. The printing machine of claim 1 in which the plating device (12) has a plating element that is adjustably positionable into a position that forms a tangent to the outer surface of said one roller.

11. The printing machine of claim 1 in which the plating device (12) has a plating element (19) that is adjustable into a position that forms a secant to the outer surface of the one roller.

12. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, a plating device (12) adjustably positionable relative to an outer surface of one of the rollers (1–6) after a contact zone (10) of the one roller in the direction of rotation of the one roller for leveling the remaining ink on the surface of the one roller after passage through the contact zone, and a second plating device (12) adjustably positionable with respect to the outer surface of at least one roller (1–6) before the contact zone of the at least one roller in the direction of rotation of said at least one roller for smoothing ink on the surface of said at least one roller.

13. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, and a plating device (12) adjustably movable in a tangential direction with respect to an outer surface of one of the rollers (1–6) after a contact zone (10) of the one roller in the direction of rotation of the one roller for leveling the remaining ink on the surface of the one roller after passage through the contact zone.

14. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, a plating device (12) adjustably positionable relative to an outer surface of one of the rollers (1–6) in said roller train for leveling the remaining ink on the surface of the one roller after passage through the contact zone, said one roller being an ink fountain roller (1) associated with an ink fountain (9) having an ink metering device (8), and said plating device 12 being adjustably positionable with respect to the ink fountain roller (1) at a location in the direction of rotation of the ink fountain roller (1) after a contact zone (10) with a downstream roller (2, 6) and before the ink metering device (8).

15. The printing machine of claim 14 in which said downstream roller is a vibrating roller (2).

16. The printing machine of claim 14 in which said downstream roller is a film roller (6).

17. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, a plating device (12) adjustably positionable relative to an outer surface of one of the rollers (1–6) after a contact zone (10) of the one roller in the direction of rotation of the one roller for leveling the remaining ink on the surface of the one roller after passage through the contact zone, and said plating device 12 having a plating element (19) biased against the one cylinder by a compression spring.

18. The printing machine of claim 17, in which said plating device is positionable against an outer surface of the one roller with a predetermined force F.

19. The printing machine of 17, in which said plating device can be set against an outer surface of the one roller (1) with a uniform surface pressure applied across the longitudinal length of the one roller (1) by the plating device (12).

20. The printing machine of claim of 17, in which the printing device (12) has a plating element (19) with an end located at a secant point on the outer surface of the one roller.

21. A printing machine comprising at least one printing cylinder, at least one roller train leading to the printing cylinder, a storage container of liquid printing medium, a metering system for metering the printing medium onto the roller train, said roller train comprising rollers in contact with each other at respective contact zones where pulling off and separation of the printing medium occurs between rollers as surfaces of the rollers pass through the respective contact zone, a plating device (12) adjustably positionable relative to an outer surface of one of the rollers (1–6) after a contact zone (10) of the one roller in the direction of rotation of the one roller for leveling the remaining ink on the surface of the one roller after passage through the contact zone, and said plating device (12) having a plating element (19) with an end located at a tangent point on the outer surface of the one roller (1).

22. The printing machine of claim of 21 in which said plating device (12) has a plating element (19) with an end located at a predetermined small distance beyond the outer surface of the one roller.

* * * * *